United States Patent [19]

Niimura et al.

[11] 3,949,156

[45] Apr. 6, 1976

[54] FLOOR CABLE WITH FOLDED PORTIONS FOR MAKING BRANCH CONNECTIONS AND METHOD OF PRODUCING SAME

[75] Inventors: Nagato Niimura; Ichiro Kinoshita, both of Tokyo; Yoshiharu Maruyama, Naka; Ryuichi Kurihara, Tokyo; Morito Yoshihara, Tokyo; Toshio Suzuki, Hitachi; Yujiro Hashimoto, Hitachi; Masahiro Imazawa, Hitachi, all of Japan

[73] Assignees: Hitachi Cable Limited; Nippon Telegraph & Telephone Public Corporation, both of Tokyo, Japan

[22] Filed: Dec. 11, 1974

[21] Appl. No.: 531,504

[30] Foreign Application Priority Data

May 11, 1974 Japan ..... 48-52674

[52] U.S. Cl. ..... 174/72 R; 29/624; 140/102; 156/50; 174/10; 174/72 TR

[51] Int. Cl.² ..... H01B 7/00; H01B 13/00

[58] Field of Search ..... 174/10, 71 R, 72 R, 72 A, 174/72 TR, 113 R, 113 AS, 117 M; 29/624; 140/71 R, 102, 105; 156/47, 50

[56] References Cited

UNITED STATES PATENTS

| | | | |
|---|---|---|---|
| 782,391 | 2/1905 | Hanson | 174/72 TR |
| 3,615,283 | 10/1971 | Lang | 174/72 TR X |
| 3,812,282 | 5/1974 | Johansson | 174/10 X |

FOREIGN PATENTS OR APPLICATIONS

| | | | |
|---|---|---|---|
| 608,455 | 4/1926 | France | 140/102 |
| 1,121,141 | 1/1962 | Germany | 174/72 TR |
| 503,765 | 4/1939 | United Kingdom | 174/113 AS |

*Primary Examiner*—Laramie E. Askin

*Attorney, Agent, or Firm*—Sughrue, Rothwell, Mion, Zinn & Macpeak

[57] ABSTRACT

This invention provides an improved structure of a floor cable used, for example, for a telephone cord in an office room, and also a method of producing such floor cable. The floor cable comprises a plurality of insulated core wires within a plastic cable sheath.

Each of the insulated core wires has a plurality of folded portions along the wire length, and the cable sheath for the core wires has such cross section that a plurality of radial fins are provided on the thin circumference. Thus, the ripping out of the sheath for drawing out the desired wire to connect or branch the floor cable can be easily carried out.

7 Claims, 8 Drawing Figures

FLOOR CABLE WITH FOLDED PORTIONS FOR MAKING BRANCH CONNECTIONS AND METHOD OF PRODUCING SAME

BACKGROUND OF THE INVENTION

1. Field of the Invention

This invention relates to a floor cable used for a telephone cord or the like to be laid in an office room or like chamber, and also to a method of producing such floor cable.

2. Prior Art of the Invention

Telephone cords or the like cables in an office room are usually laid under the floor to keep the fine appearance of the room.

This cable laid under the floor includes much of the core wires and accordingly is required to branch off the core wires in the use. The branching of the core wires is carried out by ripping first the sheath, drawing out the desired wire and, if necessary, attaching a branch wiring box to the open portion of the cable. The easiness or the difficulty of the branching work is dependent on that of the sheath ripping and that of the drawing out of the core wire.

The ripping of the sheath for the branching of connecting of the cable is usually carried out using a knife or like tool. A part of the cable sheath is first cut slantly by a knife, and the edge point is forceably thrust into a narrow space between the sheath and the cable core to rip out the sheath. As this cutting work is invisible and carried out on intuition and delicate touch, an untrained worker other than a skilled worker often damages the cable core and gets hurt during cutting.

An improved cable structure which includes high strength designated as "rip cords" in the sheath for facilitating the ripping work has been proposed, but the ripping of such cable is not so easy as the sheath must be cut for drawing out the rip cords.

Another improved structure of the cable has been proposed to obtain slacks or surplusages of the core wires by twisting the core wires, but full slacks are not achieved due to the low twisting ratio.

In order to obtain further slacks in the core wires, a cable structure wherein the twisted or bundled core wires are rippled has been proposed, but such cable has the defect that the rippled core wires occupy much space in the sheath and the outer diameter of the cable becomes too large.

PREFERRED EMBODIMENTS OF THE INVENTION

Figure 1:
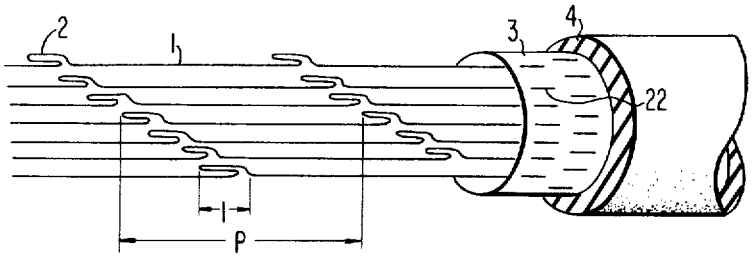
FIG. 1 is a partly cut out perspective view of the floor cable according to this invention.

Referring to the FIG. 1, an insulated single or twisted core wire 1 has a plurality of folded parts or portions 2 at regular intervals along the wire length. Many wires are bundled by a wound tape 3, and a plastic sheath 4 covers said wound tape 3.

Each of said folded portions 2 of the insulated wires 1 may be easily stretched and straightened by pulling it lengthwise, and accordingly a surplus length $l$ per unit length of the wire corresponding to the folded length can be drawn out from the cable end.

In order to obtain the long surplus length of the wire, the folded portions 2 must be long.

A too long folded portion 2, however, is not preferable since kinks are often caused. The work "kink" means a phenomenon of break or snap of the wire at one point therein. Where a kink is formed, the communication becomes duely impossible.

Figure 2:
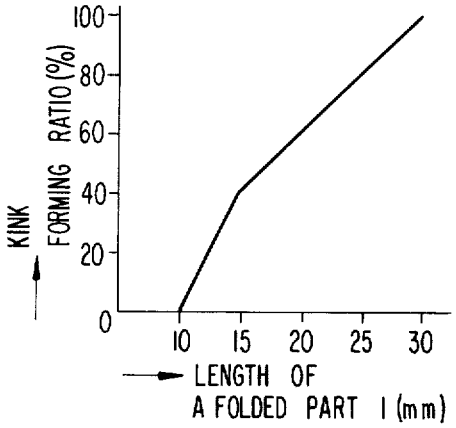
FIG. 2 is a graph showing a relation between a length of a folded portion of a core wire and a kink forming ratio.

Tests for the kink forming ratio were carried out using as the insulator of the wire a high density polyethylene having high mechanical strength, excellent wear resistance and extremely low friction coefficient, as shown in FIG. 2. It will be apparent from FIG. 2 that the kinks form necessarily (100%) with 30mm of the folded length $l$ of the core wire, 60% with 20mm of the folded length, 40% with 15mm of the folded length and not at all (0%) with the folded length under 10mm.

In order to prolong the surplus length of the core wire, the shortening of the pitch P of the folded portion 2 (or the interval between the neighboring two folded portions) has been proposed. It turned out, after many experimental works, that about 25% of the surplus length per unit length of the wire was required for the connection of such cables and accordingly the favorable pitch P of the folded portion was not more than 80mm with the folded length under 10mm.

The folded portions of the core wires are preferably provided in the cable in the uniformly dispersed state, as shown in FIG. 1.

Where the folded portions are located at a longitudinally same position, the diameter of the cable must be unwillingly increased.

The cable core thus formed is bundled by winding thereon a plastic tape 3 such as vinyl chloride or polyethylene, or a cotton tape 3, A plurality of slits 22 are preliminarily formed within the bundling tape 3.

Thus, the floor cable connecting work will be carried out easily by opening the slits 22 of the bundling tape 3 by a knife or the like tool and drawing out instantly the core wire.

Figure 3:
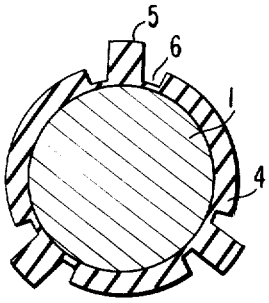
FIG. 3 is a lateral cross section of a sheath of the floor cable according to this invention.

A structure where the sheath may be easily ripped out is shown in FIG. 3. A plurality of radial fins 5 are provided on the outer periphery of the plastic sheath 4. These fins 5 are continuous along the length of the cable, and grooves 6 are provided at both sides of each wall at fin 5. The groove 6 is thinner than the other sheath wall, so that a rip or tear is easily formed at the groove by pulling the fin 5 with a pliers or the like tool. If more than three fins are provided on the outer periphery of the sheath, at least one fin is ready for the sheath ripping work as it faces the floor box laid under the floor, thus facilitating the sheath ripping work in the narrow space. The shape of the groove 6 is not restricted, and may be thinner than the remaining thickness of the sheath wall to such extent as to be easily ripped out.

Such sheath structure enables the untrained worker to carry out the sheath ripping work efficiently and without damaging the cable core.

Figure 4:
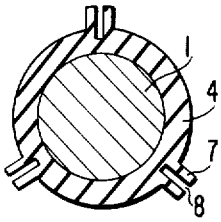
FIG. 4 is a lateral cross section of another sheath of the floor cable according to this invention.
Figure 5:
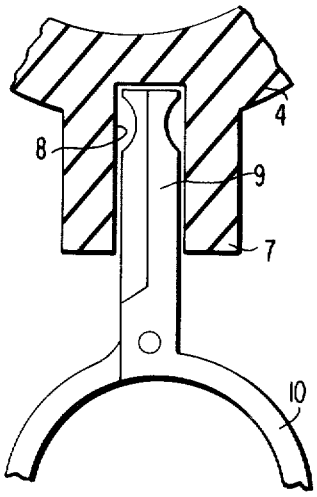
FIG. 5 is a lateral cross section of another sheath of a floor cable according to this invention and a tool for ripping open the sheath.

Another example of the cable sheath structure is shown in FIG. 4, wherein a slit 8 is provided on each of the fins so that a tip of the ripping tool may be thrust therein. The circumference of the sheath other than the fins has a uniform thickness, and the depth of the slit 8 is greater than the radial height of the fin 7. In other words, the bottom of the slit 8 is located radially inwards of the outer periphery of the sheath 4. In order to rip out the fin 7, a tip 9 of the ripping tool is inserted into the slit 8, as shown in FIG. 5. The tip 9 of this ripping tool is opened outwards by gripping a handle 10, and a ripping edge is provided at the point of the tool. The edge is sharpened to facilitate its boring into or cutting of the fin.

The ripping out of the fin 7 may also be carried out by inserting a screw driver into the slit 8 and twisting it therein without use of such special tool.

More than three fins and slits are preferably provided on the periphery of the sheath in the same way as described hereinbefore.

Figure 6:
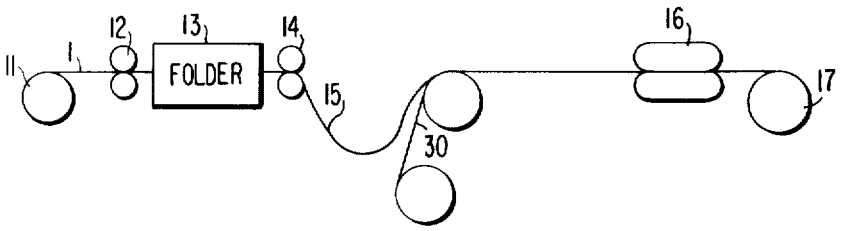
FIG. 6 is a schematic view of an apparatus for producing the floor cable according to this invention.
Figure 7:
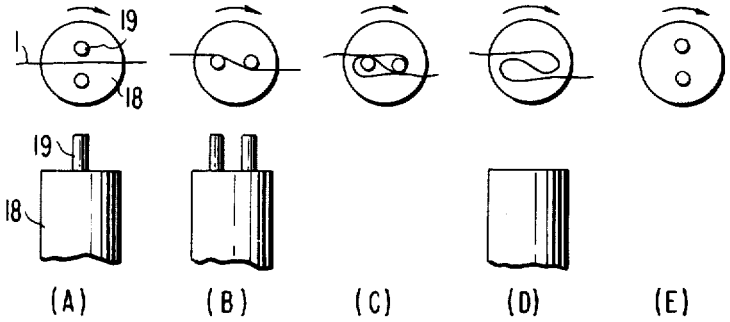
FIG. 7 is a schematic view of a mechanism of a folding device.

The production of the cable core will be described with reference to FIGS. 6, 7 and 8. A core wire 1 is fed from a supply machine 11 to a folder 13, wherein the core wire is put between a pair of fork shaped pins 19 attached to body 18 and the fork is rotated to form the folded portion on the wire, as shown in FIG. 7. After the folded portion is formed, the pins 19 are retired and disengaged from the core wire.

A cycle of the motion of the fork pins includes (A)-(E) stages, and the (D) stage shows that the fork pins retire and the engagement between the folded core wire and the fork pins is released. The core wire is kept untensioned during the folding work by a pair of rolls 12 and 14. For this purpose, the feeding velocity of the roll 12 is made larger than that of the roll 14 to prevent the generation of tension on the core wire and the restretching of the folded portion. A wire accumulator zone 15 is provided on the line of the core wire behind the folder, and the folded core wire is then fed on the tape winding station 30, and it is fed in order to a caterpillar type pulling machine 16 and a take-up machine 17.

Figure 8:
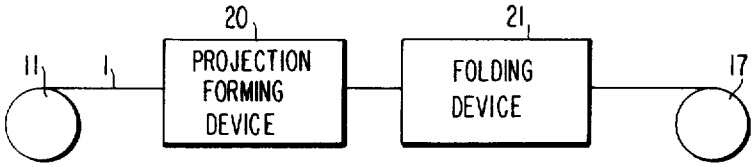
FIG. 8 is a schematic view of another apparatus for producing the floor cable according to this invention.

Another example of the cable core producing method is shown in FIG 8. The insulated core wire 1 is introduced from the supply machine 11 to a projection forming device 20, wherein a folded projection perpendicular to the longitudinal direction of wire is formed. Then, the projection formed core wire is introduced into a folding device 21, wherein the perpendicular projections are laid down to form the folded portions, and the resultant core wires are fed to a take-up machine 17.

The forming of the projections is carried out, for example, by passing the core wire through an aperture reciprocated laterally by piston means, or through a roller assembly composed of a roller having the surface projection and a party roller having the recess.

The laying down of the perpendicular projections is carried out by passing the projection formed core wire through a roller assembly or by bending the projections with a compressor or dies.

As particularly described above, the floor cable readily connected with the other cable can be provided easily and economically according to this invention.

While this invention has been described with reference to particular embodiments thereof, it will be understood that numerous modifications may be made by those skilled in the art without actually departing from the scope of the invention.

Therefore, the appended claims are intended to cover all such equivalent variations as coming within the true spirit and scope of the invention.

What is claimed is:

1. A floor cable comprising a cable core formed of a plurality of longitudinally extending insulated wires within a plastic outer cable sheath, the improvement comprising: each of said insulated wires having a plurality of folded portions along the wire length at given intervals.

2. A floor cable according to the claim 1, wherein the length of each folded portion is less than 10mm.

3. A floor cable according to the claim 1, wherein a bundling tape surrounds the folded core wires and has a plurality of slits therein.

4. A floor cable according to claim 1, wherein said cable sheath surrounding said cable core has a lateral cross section with a plurality of radial fins provided on the outer periphery of the cable sheath, and both side zones of the cable sheath adjacent the fins are thinner than the other zones of the cable sheath separating the sheath fins.

5. A floor cable according to claim 1 wherein said cable sheath has a lateral cross section with a plurality of radial fins provided on the outer periphery of the cable sheath, and a radial slit deeper than the radial height of the fin is provided within each fin from the outer end of the fin radially inwards.

6. A method of producing a floor cable which comprises a plurality of longitudinally extending insulated core wires within a plastic outer sheath with each of the insulated core wires having a plurality of folded portions along the wire length at regular intervals, the improvement comprising: the step of forming a plurality of folded portions along the wire length at given intervals as said core wires are fed longitudinally in the direction of their axes and the step of drawing out of the folded core wire at a velocity which is slower than the feeding velocity of the core wires prior to the production of the folded portions along the wire length.

7. The method of producing a floor cable as claimed in claim 6, further comprising the step of forming said plurality of wire folded portions on the core wires perpendicular to the longitudinal drawing direction of the wire and then laying the perpendicular portions down upon the core wire portions.

* * * * *